United States Patent [19]

Kikuchi et al.

[11] Patent Number: 4,645,277

[45] Date of Patent: Feb. 24, 1987

[54] CONNECTOR FOR CONNECTING BOARDS

[75] Inventors: Hiroshi Kikuchi; Minoru Teshima; Hideaki Ishimizu; Hiroyoshi Kawasaki, all of Tokyo, Japan

[73] Assignee: Oki Electric Industry Co., Ltd., Tokyo, Japan

[21] Appl. No.: 746,561

[22] Filed: Jun. 19, 1985

[30] Foreign Application Priority Data

Jun. 21, 1984 [JP] Japan ..... 59-91686[U]

[51] Int. Cl.[4] ..... H01R 9/09

[52] U.S. Cl. ..... 339/17 LM; 339/176 MP

[58] Field of Search ..... 339/17 L, 17 LM, 17 LC, 339/17 M, 64 R, 176 MP

[56] References Cited

U.S. PATENT DOCUMENTS

| | | | |
|---|---|---|---|
| 3,633,152 | 1/1972 | Podmore | 339/91 R |
| 4,025,142 | 5/1977 | Huber et al. | 339/128 |
| 4,133,592 | 1/1979 | Cobaugh et al. | 339/17 LC |
| 4,264,114 | 4/1981 | Chandler | 339/17 LC |
| 4,439,000 | 3/1984 | Kaufman et al. | 339/17 LM |

FOREIGN PATENT DOCUMENTS

| | | |
|---|---|---|
| 0125780 | 11/1984 | European Pat. Off. . |
| 1914489 | 11/1969 | Fed. Rep. of Germany . |
| 1490440 | 11/1969 | Fed. Rep. of Germany . |

*Primary Examiner*—Neil Abrams

*Attorney, Agent, or Firm*—Wenderoth, Lind & Ponack

[57] ABSTRACT

A connector housing has an insertion slot for receiving a companion base board, a plurality of grooves defined in a housing bottom in a direction normal to the insertion slot, and a plurality of pin attachment holes disposed between the insertion slot and the grooves. Contact pins are approximately L-shaped and pivotally held in the pin attachment holes, respectively, in the vicinity of central bent portions of the contact pins. When the connector housing is attached to a base board and the companion board is inserted in the insertion slot, ends of the contact pins are connected to a circuit pattern on the base board and opposite ends of the contact pins are connected to a circuit pattern on the companion board. The base and companion boards are therefore electrically connected to each other substantially perpendicularly to each other.

3 Claims, 9 Drawing Figures

Fig. 3 (II)

Fig. 3(III)
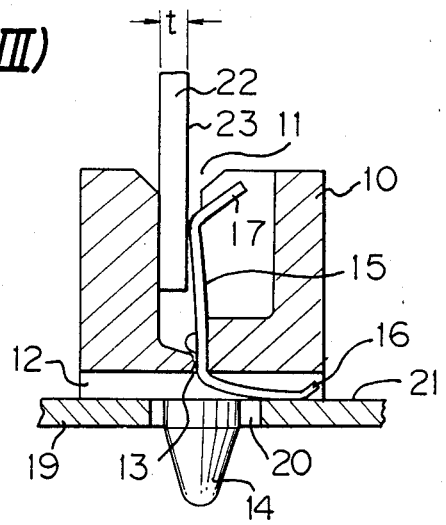

CONNECTOR FOR CONNECTING BOARDS

BACKGROUND OF THE INVENTION

1. Field of the Invention

The present invention relates to a connector for interconnecting printed-circuit boards.

2. Description of the Related Art

One known method of interconnecting printed-circuit boards substantially at a right angle has been to insert one of the printed-circuit boards (hereinafter referred to as a "companion board") into a connector attached to the other printed-circuit board (hereinafter referred to as a "base board"). Conventional board connectors comprise a connector housing and contact pins integrally embedded in the molded connector housing, the connector housing having an insertion slot for receiving the companion board. The contact pins have ends projecting from the bottom of the connector housing and connected to an electric circuit pattern on the base board. The contact pins are soldered to the electric circuit pattern on either the face of the base board or the back thereof through holes defined in the base board. The other ends of the contact pins extend into the insertion slot. When the companion board is inserted into the insertion slot, the other ends of the contact pins are connected through pressed engagement to an electric circuit pattern on the companion board.

However, since the prior connector is completely fixed by soldering to the base board, no positional flexibility is available of the companion board. If the contact pins were small in size or spaced at small pitches or pin-to-pin intervals, difficulty would be experienced in getting the contact pins soldered to the electric circuit pattern.

SUMMARY OF THE INVENTION

It is an object of the present invention to provide a base board connector which can give positional flexibility to a companion board and which is small in size and can easily be attached to a base board.

According to the present invention, a board connector comprises a connector housing having an insertion slot for receiving a companion board and a plurality of grooves defined in the bottom of the connector housing in a direction normal to the insertion slot. The connector housing also has a plurality of pin attachment holes extending between the grooves and the insertion slot. The connector also has a plurality of approximately L-shaped contact pins held in the vicinity of bent portions thereof in the pin attachment holes, and guides mounted on the connector housing for being loosely fitted in positional adjustment holes defined in a base board on which the connector is to be mounted. The contact pins are shaped so as to have leg portions intersecting at the bent portions at angles slightly greater than 90°.

With the foregoing arrangement, the contact pins can be pressed against electric circuit patterns on the base board and the companion board by inserting the companion board into the insertion slot, thereby electrically connecting the base and companion boards. Since the connector housing is movable with respect to the base board for an interval corresponding to the looseness of the guides in the positional attachment holes in the base board, the companion board is positionally flexible with respect to the base board.

The contact pins are pivotally movably held in the vicinity of their bent portions, so that the contact pins can be reduced in length without lowering the force with which they are pressed against the patterns of the boards. Therefore, the connector is small in size. Since the connector is not soldered to the base board, it can easily be attached to the base board.

The above and other objects, features and advantages of the present invention will become more apparent from the following description when taken in conjunction with the accompanying drawings in which preferred embodiments of the present invention are shown by way of illustrative example.

BRIEF DESCRIPTION OF THE DRAWINGS

FIGS. 3(I), 3(II), 3(III) and 3(IV) are transverse cross-sectional views showing the manner in which the connector of the first embodiment operates in connecting boards;

DETAILED DESCRIPTION OF THE PREFERRED EMBODIMENTS

Figure 1:
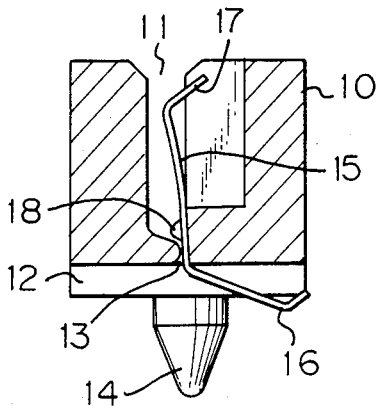
FIG. 1 is a transverse cross-sectional view of a connector for connecting boards according to the first embodiment of the present invention.
Figure 2:
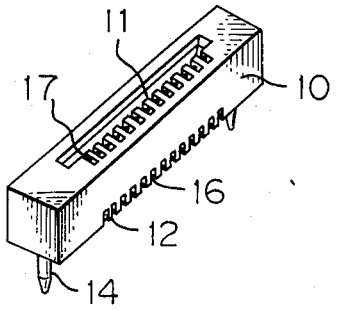
FIG. 2 is a perspective view of the connector shown in FIG. 1.

As shown in FIGS. 1 and 2, a connector according to a first embodiment of the present invention includes a connector housing 10 having a longitudinal insertion slot 11 at a top thereof for receiving therein a companion board, a plurality of transverse grooves 12 defined in a bottom of the connector housing 10 and extending in a direction normal to the insertion slot 11, and a plurality of pin attachment holes 13 defined between the insertion slot 11 and the grooves 12. The connector also includes guides 14 projecting from the bottom of the connector housing 10.

Approximately L-shaped contact pins 15 made of springy metal are held in the pin attachment holes 13 in the vicinity of the central bent portions thereof such that the contact pins 15 have ends 16 projecting through the bottom of the connector housing 10 and opposite ends 17 positioned in the insertion slot 11. As is illustrated in FIG. 1, the "L" shape of each contact pin is defined by leg portions intersecting at the bend portion at an angle slightly greater than 90°. The contact pins 15 are pivotally movable about their bent portions in the pin attachment holes 13. The contact pins 15 have respective fingers 18 close to the bent portions thereof projecting into the pin attachment holes 13 for retaining the bent portions of the contact pins 15 in the pin attachment holes 13.

Figure 3:
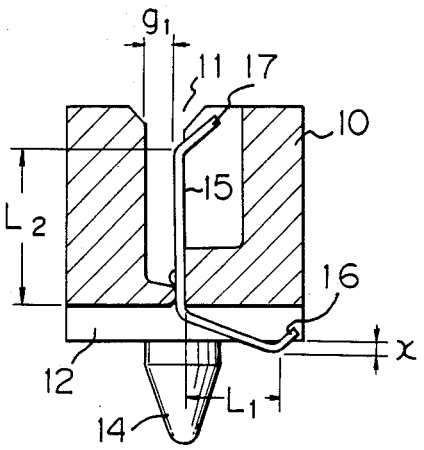
Figure 3:
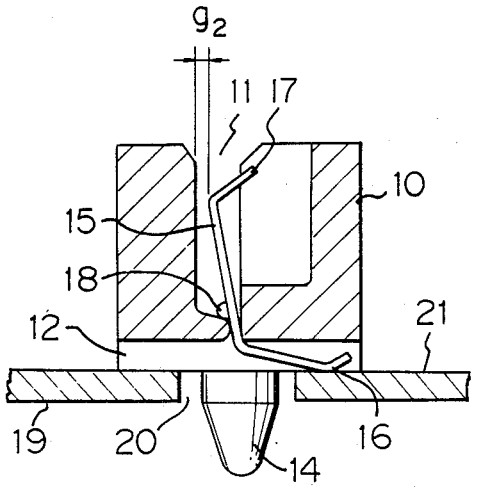
Figure 3:
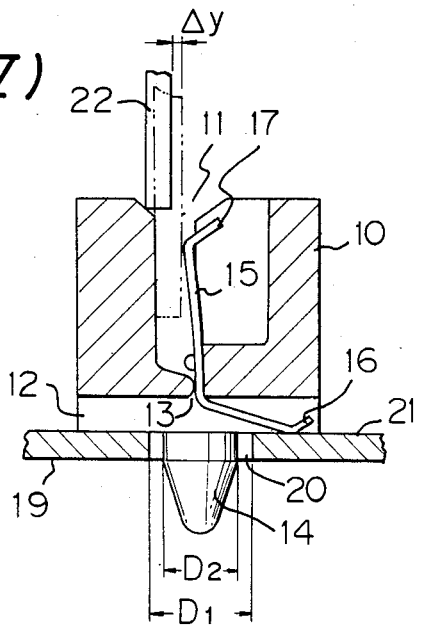

Operation of the connector is as follows:

FIG. 3(I) shows the connector in its free state, i.e., before it is attached to the base board. FIG. 3(II) illustrates the connector as it is mounted on the base board.

The base board 19 has positional adjustment holes 20 (only one shown) defined therethrough and having a diameter greater than the outside diameter of the guides 14. An electric circuit pattern 21 is formed on the surface of the base board 19 on which the connector housing 10 is mounted, the electric circuit pattern 21 having terminal portions for contact with the projecting ends of the contact pins 15.

The connector housing 10 has screw insertion holes (not shown) defined through opposite ends thereof. The connector housing 10 is fastened to the base board 19 by screws extending through screw insertion holes. The screw insertion holes have a diameter larger than the outside diameter of the screws so that the screws as loosened are laterally movable in the screw insertion holes for positional adjustment of the connector.

When the connector is in its free state as shown in FIG. 3(I), the ends 16 of the contact pins 15 below the bottom of the connector housing 10 project about an interval x from the bottom of the connector housing 10. When the connector is attached to the base board 19 as shown in FIG. 3(II), the projecting ends 16 of the contact pins 15 are pushed upwardly by the base board 19 to a position aligned with the bottom of the connector housing 10 and are disposed in the respective grooves 12. Since the contact pins 15 are turned about their own bent portions in the pin attachment holes 13, the opposite ends 17 of the contact pins 15 are moved a distance $(L2/L1)\cdot x$. The contact pins 15 are now spaced from the inner wall surface of the connector housing 10 by a distance $g_2=g1-(L2/L1)\cdot x$ in FIG. 3(II).

At this time, the ends 16 of the contact pins 15 contact the pattern 21 on the base board 19 under substantially no pressure, and hence the connector can freely be positionally adjusted with respect to the base board 19 for an interval corresponding to the looseness indicated by $(D_1\text{-}D_2)$ (FIG. 3(IV)) between the edges defining the positional adjustment holes 20 in the base board 19 and the guides 14 on the connector housing 10.

FIG. 3(III) shows the position in which a companion board 22 is inserted into the insertion slot 11 in the connector housing 10 mounted on the base board 19. If the companion base board 22 is to be fixedly positioned with respect to the base board 19 with a positional error of $\Delta y$, for example, as shown in FIG. 3(IV), then the companion board 22 is inserted into the insertion slot 11 while displacing the connector by the interval $\Delta y$. The error $\Delta y$ should be smaller than the looseness $(D_1\text{-}D_2)$ shown in FIG. 3(IV) between the edges defining the positional adjustment holes 20 in the base board 19 and the guides 14 on the connector housing 10.

When the companion board 22 is inserted in the insertion slot 11, an electric circuit pattern 23 on the companion board 22 is brought into contact with the ends 17 of the contact pins 15. The companion board 22 is now fixed with respect to the base board 19 substantially perpendicular thereto and simultaneously connected electrically to the base board 19.

Provided the companion board 22 has a thickness t as shown in FIG. 3(III), the extent $\Delta t$ to which the contact pins 15 flex at the ends 17 is given by:

$$\Delta t = t - \left(g_1 - \frac{L2}{L1}\cdot X\right)$$

The pattern 23 is held in good electrical contact with the contact pins 17 by the flexing extent $\Delta t$ and the resilient force of the contact pins 15 themselves. Since the contact pins 15 are caused to flex about free fulcrums near their bent portions, forces applied to the contact pins 15 are distributed to the ends 16, 17. The pressures $P_1$, $P_2$ under which the contact pin ends 16, 17 are pressed against the patterns 21, 23, respectively, are expressed by:

$$P_1 = \frac{3\cdot\Delta t\cdot EI}{L1^2\cdot(L1+L2)} \tag{1}$$

$$P_2 = \frac{L1\cdot 3\cdot\Delta t\cdot EI}{L2\cdot L1^2\cdot(L1+L2)} \tag{2}$$

where E is the Young's modulus of the contact pins, and I is the second moment of inertia.

With the conventional connector, the pressure $P_2'$ under which the contact pin ends 17 are pressed against the pattern is given by:

$$P_2' = \frac{3\cdot\Delta t\cdot EI}{L'2^3} \tag{3}$$

$$\frac{P_2}{P_2'} = \frac{\dfrac{3\cdot\Delta t\cdot EI}{L2\cdot L1\cdot(L1+L2)}}{\dfrac{3\cdot\Delta t\cdot EI}{L'2^3}} \tag{4}$$

If for practical purposes $L1=L2$, then $$\frac{P_2}{P_2'} = \frac{L'2^3}{2L2^3} \tag{5}$$

If the length is constant, or $L_2=L'_2$ $$\frac{P_2}{P_2'} = \frac{L2^2}{2L2^2} = \frac{1}{2} \tag{6}$$

Therefore, the contacting pressure with the connector of the invention is about ½ of that with the conventional connector If the contacting pressure is constant, or $P_2=P_2'$, then from the equation (5), $$\frac{P_2}{P_2'} = 1 = \frac{L2'^3}{2L2^3} \tag{7}$$

$$\therefore L_2 = \sqrt[3]{\frac{1}{2}}\cdot L_2' = 0.79\cdot L_2' \tag{8}$$

Stated otherwise, the length from the free fulcrums of the contact pins 15 can be reduced to substantially ¾ of that of the contact pins of the conventional connector.

Figure 4:
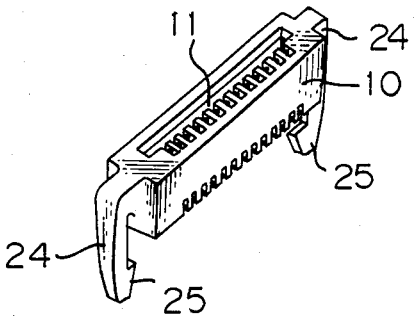
FIG. 4 is a perspective view of a connector according to a second embodiment of the present invention.
Figure 5:
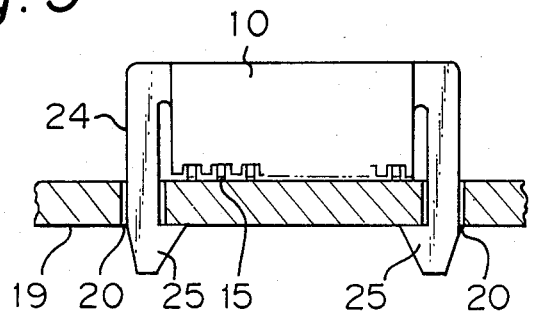
FIG. 5 is a front elevational view of the connector shown in FIG. 4, as mounted on a base board.

FIG. 4 shows a connector according to a second embodiment of the present invention. The connector of FIG. 4 is composed of a connector housing 10 having guides 24 on opposite ends thereof, the guides 24 having engagement pawls 25. In use, the connector can be attached to a base board 19 simply by forcing the engagement pawls 25 through positional adjustment holes 20 in the base board 19. Therefore, the connector shown in FIG. 4 can more easily be mounted on the base board than the connector of the first embodiment which is required to be fastened to the base board by screws. Since the guides 24 double as attachments to the base board 19, the connector is simple in construction. The other structures of the connector of FIG. 4 remain the same as those of the first embodiment. A companion board can be electrically connected to the base board by being inserted into an insertion hole 11 in the connector housing 10.

Figure 6:
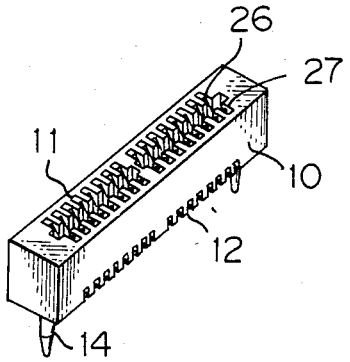
FIG. 6 is a perspective view of a connector according to a third embodiment of the present invention.

FIG. 6 shows a connector according to a third embodiment of the present invention. While the connectors of the first and second embodiments are used for connecting the base board to the companion board which has a printed circuit on one surface thereof, the connector of the third embodiment is designed for connecting the base board to a companion board having printed circuits on opposite surfaces thereof.

More specifically, the connector of FIG. 6 includes a connector housing 10 having an insertion slot 11 and guides 14. Contact pins 26, 27 are disposed in two rows in symmetric relation with respect to a companion board to be inserted into the insertion slot 11, the contact pins 26, 27 being supported in pin attachment holes in the connector housing 10. The contact housing 10 has a plurality of grooves 12 defined in a bottom thereof and extending in a direction normal to the insertion slot 11. When the companion board is inserted into the insertion slot 11, the contact pins 26, 27 are held in contact with printed circuit patterns on the opposite surfaces of the companion board.

Although certain preferred embodiments have been shown and described, it should be understood that many changes and modifications may be made therein wihout departing from the scope of the appended claims.

What is claimed is:

1. A connector for electrically interconnecting a base printed-circuit board and a companion printed-circuit board in substantially perpendicular relation to each other, comprising:

(a) a connector housing having an insertion slot opening at the top thereof for receiving the companion printed-circuit board therein, a plurality of grooves defined in a bottom of the connector housing in a direction normal to said insertion slot, and a plurality of pin attachment holes disposed between said grooves and said insertion slot;

(b) a pair of guides mounted on opposite ends of said connector housing for loosely fitting engagement in positional adjustment holes defined in the base printed-circuit board; and (c) a plurality of contact pins each having bent portions, and first and second leg portions intersecting at said bent portions at an angle slightly greater than 90°, pivotally held in respective one of said pin attachment holes in the vicinity of said bent portions of the contact pin, said contact pins having ends positionable respectively in said grooves and opposite end extending into said insertion slot, whereby when said connector housing is attached to said base printed-circuit board and said companion printed-circuit board is inserted into said insertion slot, said contact pins are pressed against circuit patterns on said printed-circuit boards respectively at the ends of said contact pins.

2. A connector according to claim 1, wherein each of said guides has an engagement pawl at its distal end.

3. A connector according to claim 1, wherein said contact pins are provided in a pair of rows symmetrically with respect to the companion printed-circuit board for contact with circuit patterns on opposite surfaces of said companion printed-circuit board.

* * * * *